US010982892B2

(12) United States Patent
Bertolini et al.

(10) Patent No.: US 10,982,892 B2
(45) Date of Patent: Apr. 20, 2021

(54) REFRIGERATOR HAVING ICE MAKER AND REFRIGERATION CIRCUIT THEREFOR

(71) Applicants: BSH Home Appliances Corporation, Irvine, CA (US); BSH Hausgeräte GmbH, Munich (DE)

(72) Inventors: Nilton Bertolini, Knoxville, TN (US); Silas Patrick Mallon, Knoxville, TN (US); Jorge Carlos Montalvo Sanchez, Knoxville, TN (US)

(73) Assignees: BSH Home Appliances Corporation, Irvine, CA (US); BSH Hausgeräte, Munich (DE)

( * ) Notice: Subject to any disclaimer, the term of this patent is extended or adjusted under 35 U.S.C. 154(b) by 0 days.

(21) Appl. No.: 16/894,921

(22) Filed: Jun. 8, 2020

(65) Prior Publication Data

US 2020/0300526 A1 Sep. 24, 2020

Related U.S. Application Data

(63) Continuation of application No. 15/643,591, filed on Jul. 7, 2017.

(51) Int. Cl.

| | |
|---|---|
| ***F25C 1/04*** | (2018.01) |
| ***F25C 1/243*** | (2018.01) |
| ***F25C 5/20*** | (2018.01) |
| ***F25C 5/185*** | (2018.01) |
| ***F25C 5/08*** | (2006.01) |
| ***F25D 17/06*** | (2006.01) |

(52) U.S. Cl.

CPC ..... *F25C 1/04* (2013.01); *F25C 1/243* (2013.01); *F25C 5/08* (2013.01); *F25C 5/185* (2013.01); *F25C 5/22* (2018.01); *F25D 17/065* (2013.01); *F25C 2305/022* (2013.01); *F25C 2700/02* (2013.01); *F25C 2700/12* (2013.01); *F25D 2317/061* (2013.01); *F25D 2323/021* (2013.01)

(58) Field of Classification Search

CPC ..... F25C 1/04; F25C 5/22

See application file for complete search history.

(56) References Cited

U.S. PATENT DOCUMENTS

| | | | |
|---|---|---|---|
| 2,606,428 | A | 8/1952 | Oldfather |
| 6,349,550 | B1 | 2/2002 | Shapiro et al. |
| 6,637,217 | B2 | 10/2003 | Kim et al. |

(Continued)

*Primary Examiner* — Filip Zec

(74) *Attorney, Agent, or Firm* — Michael E. Tschupp; Andre Pallapies; Brandon G. Braun

(57) ABSTRACT

A refrigerator includes a fresh food compartment; a freezer compartment; an ice compartment disposed in the fresh food compartment; an ice maker disposed in the ice compartment, the ice maker including an ice tray, an ice maker evaporator, and a cooling tube which is disposed between the ice maker tray and the ice maker evaporator, such that the cooling tube is in direct contact with the ice maker tray and the ice maker evaporator; and a refrigeration circuit including a compressor, a condenser, a refrigerant valve, the ice maker evaporator, and a freezer compartment evaporator. The refrigerant valve directs a refrigerant to one of a first path or a second path of the refrigeration circuit, the first path causing the ice maker evaporator to work in series with the freezer compartment evaporator, and the second path causing the refrigerant to bypass the ice maker evaporator to the freezer compartment evaporator.

3 Claims, 14 Drawing Sheets

(56) References Cited

U.S. PATENT DOCUMENTS

| | | | |
|---|---|---|---|
| 6,655,158 | B1 | 12/2003 | Wiseman et al. |
| 7,152,424 | B2 | 12/2006 | Adachi |
| 7,266,973 | B2 | 9/2007 | Anderson et al. |
| 7,406,838 | B2 | 8/2008 | Wang |
| 7,555,909 | B2 | 7/2009 | Chang |
| 8,196,418 | B2 | 6/2012 | Kim et al. |
| 8,316,661 | B2 | 11/2012 | Choi |
| 8,534,087 | B2 | 9/2013 | Lee et al. |
| 8,584,474 | B2 | 11/2013 | McCollough et al. |
| 8,844,310 | B2 | 9/2014 | Chase et al. |
| 8,950,197 | B2 | 2/2015 | Bortoletto et al. |
| 9,528,741 | B2 | 12/2016 | Subera |
| 2005/0150250 | A1 | 7/2005 | Allison et al. |
| 2008/0295539 | A1 | 12/2008 | An et al. |
| 2010/0218542 | A1 | 9/2010 | Candeo et al. |
| 2010/0257889 | A1 | 10/2010 | Lee |
| 2013/0192279 | A1 | 8/2013 | Bertolini et al. |

REFRIGERATOR HAVING ICE MAKER AND REFRIGERATION CIRCUIT THEREFOR

CROSS-REFERENCE TO RELATED APPLICATIONS

The present application is a Continuation of U.S. patent application Ser. No. 15/643,591, filed on Jul. 7, 2017, the contents of which are herein incorporated by reference in their entirety.

FIELD OF THE INVENTION

The present disclosure relates generally to a refrigerator appliance and to an ice making system disposed in a dedicated ice compartment of the refrigerator appliance. More particularly, the present disclosure relates to the control logic for controlling a compact ice making system for use in a slimline ice compartment having a side-by-side ice maker and ice bucket.

BACKGROUND OF THE INVENTION

In general, refrigerator appliances, such as for household use, typically have a bulky ice compartment for making and storing ice located within the fresh food compartment. The ice compartment assembly has an over-under arrangement where the ice maker is positioned on top and the ice bucket is located underneath the ice maker within the ice compartment.

SUMMARY OF THE INVENTION

On the other hand, making the ice compartment and bucket larger especially in the vertical height direction takes up too much volume in the fresh food compartment, thereby making it less desirable to customers/users. In this regard, customers/users want to maximize the volume of the fresh food compartment for the storage of fresh food items. Making the ice compartment taller also limits a design to be used only on taller doors (for example, it would not be useable in models with more than 1 drawer and two doors), and/or require the ice and water dispenser to be positioned at a lower position which is not ergonomically optimum for customers/users.

An apparatus consistent with the present disclosure is directed to a self-contained, dedicated compartment for producing and storing ice, without using cold air that is produced outside of the ice compartment and then ducted to and from the ice compartment.

An apparatus consistent with the present disclosure is directed to a slimline ice compartment which takes up less volume in the fresh food compartment and results in faster ice production.

An apparatus consistent with the present disclosure results in a significant reduction of the internal volume that the ice compartment takes up inside the fresh food compartment, as it combines an ice tray and an evaporator into an over-molded, single piece with the bottom of the ice maker (a metallic tray portion) also acting as an evaporator for the ice compartment. This in turn eliminates the need for an additional evaporator to cool the air inside the insulated ice compartment.

An apparatus consistent with the present disclosure results in a much higher ice production, as the evaporator cooling tube is in direct contact with the ice maker tray portion of the ice maker tray/evaporator, and this in turn reduces the time to fill the ice bucket. In particular, the ice maker tray/evaporator of the present disclosure freezes the water in the mold cavities very fast, since the ice maker tray portion temperature runs as cold as the refrigerant is evaporated.

An apparatus consistent with the present disclosure is directed to a slimline ice compartment having a side-by-side ice maker and ice bucket.

An apparatus consistent with the present disclosure is directed to control logic for controlling the compact ice making system disposed inside the slimline ice compartment. The control logic can be divided into three main blocks: 1) ice making; 2) ice harvesting; and 3) ice maintenance.

According to one aspect, the present disclosure provides a refrigerator including a fresh food compartment; a freezer compartment; an ice compartment disposed in the fresh food compartment; an ice maker assembly disposed in the ice compartment, the ice maker assembly including an ice maker tray/evaporator having an evaporator cooling tube which is in direct contact with an ice maker tray portion; a tray temperature sensor for sensing a temperature of the ice maker tray portion; an ice bucket for storing ice, the ice bucket being disposed in the ice compartment; and a controller configured to control ice making, ice harvesting, and ice maintenance based on the tray temperature sensed by the tray temperature sensor, wherein the tray temperature sensor is the only temperature sensor used to control ice making, ice harvesting, and ice maintenance.

According to another aspect, the ice maker assembly and the ice bucket are arranged side-by-side in a horizontal direction within the ice compartment.

According to another aspect, no portion of the ice bucket is located below the ice maker assembly when the ice maker assembly is projected downward in a vertical height direction.

According to another aspect, the ice compartment is disposed in an upper corner of the fresh food compartment.

According to another aspect, the refrigerator is a French door-bottom mount configuration having the fresh food compartment on top and the freezer compartment below the fresh food compartment.

According to another aspect, the ice compartment is disposed in an upper left hand corner of the fresh food compartment.

According to another aspect, the ice bucket is removably mounted in the ice compartment.

According to another aspect, the ice compartment has a thin dimension in a vertical height direction H of approximately 5.6 inches±2.0 inches, and wherein the ice compartment has a horizontal width W of approximately 10.4 inches±2.0 inches.

According to another aspect, the ice bucket has a front cover, and the front cover has an opening in a bottom portion for discharging pieces of ice.

According to another aspect, the fresh food compartment includes a door, and further comprising an ice chute for an ice dispenser and being disposed in the door, the ice chute being configured to communicate with the opening in the front cover via an ice chute extension.

According to another aspect, the evaporator cooling tube is formed of at least one of copper or a copper alloy.

According to another aspect, the ice maker tray portion is formed of at least one of aluminum or an aluminum alloy.

According to another aspect, a bottom portion of the ice maker tray/evaporator includes evaporator fins which extend downward substantially vertically.

According to another aspect, an air handler is disposed at a rear portion of the ice compartment behind the ice bucket.

According to another aspect, the air handler comprises an air passage having a motor driven fan disposed therein, wherein an inlet of the motor driven fan communicates with an airflow passage under the ice maker tray/evaporator, such that the motor driven fan creates a suction and draws cool air from the ice maker tray/evaporator and discharges the cool air through the air passage and to the ice bucket to prevent any ice pieces in the ice bucket from melting.

According to another aspect, the evaporator cooling tube is die cast over-molded inside the ice maker tray portion to form a one piece unit, such that the evaporator cooling tube is in direct contact with the ice maker tray portion.

According to another aspect, the tray temperature sensor is attached to at least one of the ice maker tray portion or a lower evaporator portion of the ice maker tray/evaporator.

According to another aspect, the tray temperature sensor is disposed on an outer portion of a gear box of the ice maker assembly and facing the ice maker tray/evaporator.

According to another aspect, the tray temperature sensor is the only temperature sensor located in the ice compartment.

According to another aspect, the tray temperature sensor comprises a thermistor.

According to another aspect, the during ice making, a refrigerant valve directs refrigerant in a liquid state through the evaporator cooling tube that is in direct contact with the ice maker tray portion, and the motor driven fan circulates air through the airflow passage under the ice maker tray/evaporator and discharges the cool air through the air passage of the air handler and to the ice bucket.

According to one aspect, the present disclosure provides a refrigerator comprising: a fresh food compartment; a freezer compartment; an ice compartment disposed in the fresh food compartment; an ice maker assembly disposed in the ice compartment, the ice maker assembly including an ice maker tray/evaporator having an evaporator cooling tube which is in direct contact with an ice maker tray portion, and a gear box for housing gears and a motor for driving a rotatable shaft for ice ejector fingers; a tray temperature sensor for sensing a temperature of the ice maker tray/evaporator; an additional temperature sensor which is at least one of disposed inside the gear box for sensing a temperature of a housing of the gear box, or disposed in a body of an electric motor driven fan which is disposed in the ice compartment; an ice bucket for storing ice, the ice bucket being disposed in the ice compartment; and a controller configured to control ice making, ice harvesting, and ice maintenance based on the temperature of the ice maker tray/evaporator sensed by the tray temperature sensor and based on the temperature of the housing of the gear box sensed by the additional temperature sensor, wherein the tray temperature sensor and the additional temperature sensor are the only temperature sensors used to control ice making, ice harvesting, and ice maintenance.

According to another aspect, the housing of the gear box is plastic and the additional temperature sensor senses a temperature of the plastic housing of the gear box.

According to another aspect, the additional temperature sensor is built into the body of the electric motor driven fan.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 7B:
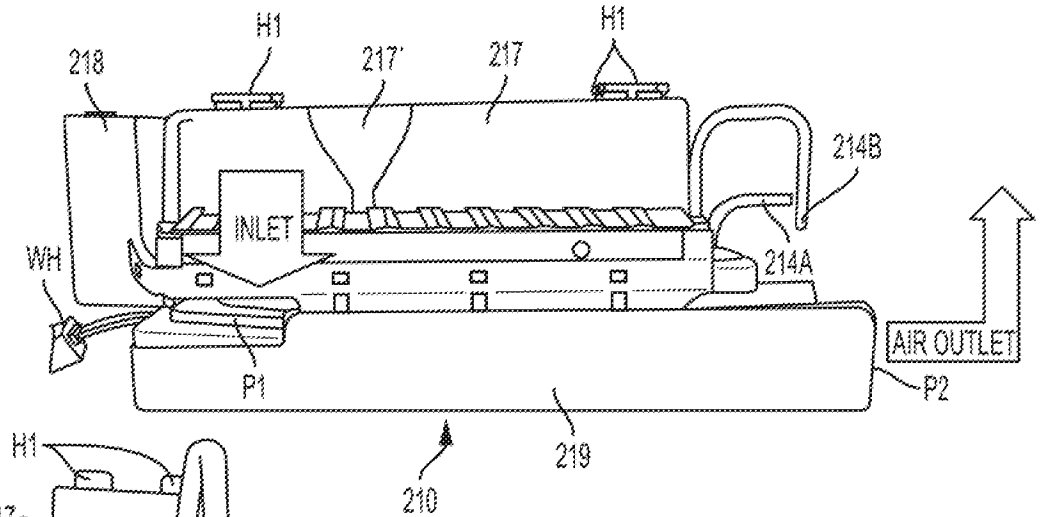
Figure 7C:
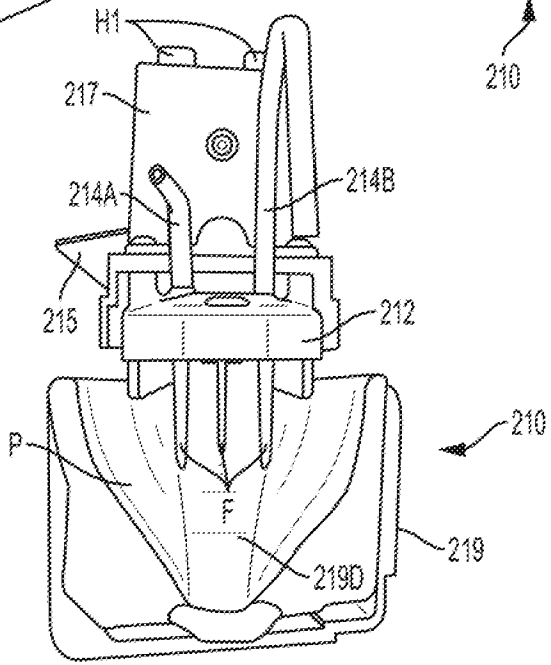
Figure 7A:
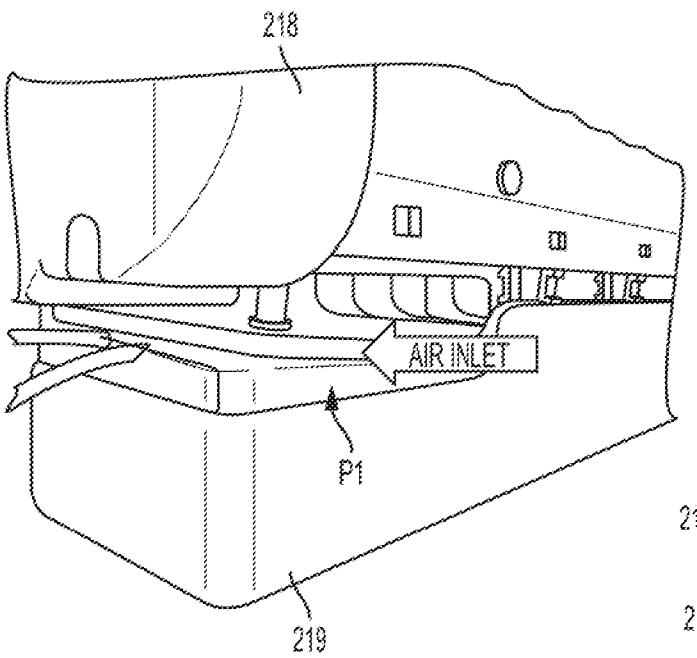
Figure 8B:
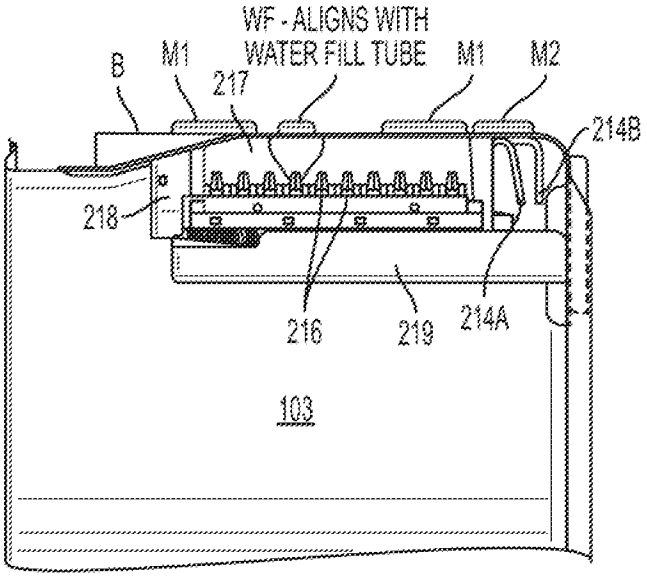
Figure 8C:
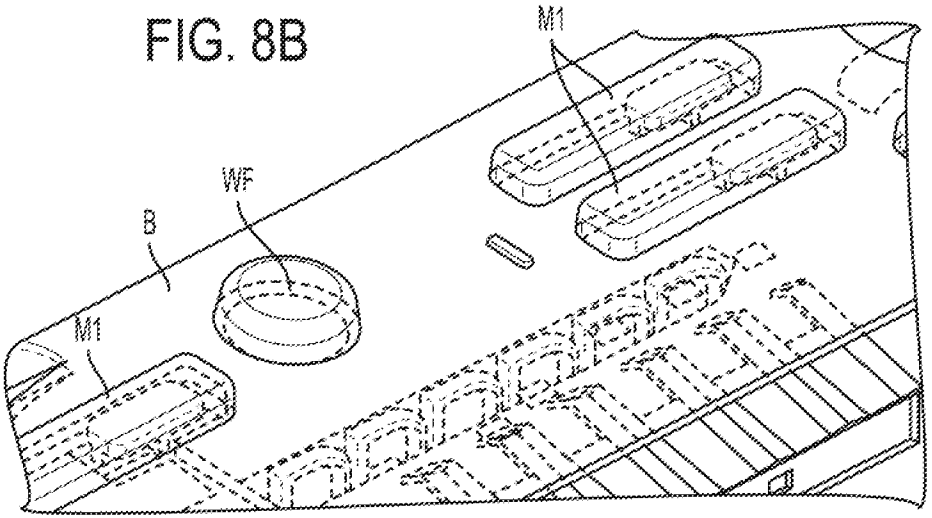
Figure 8A:
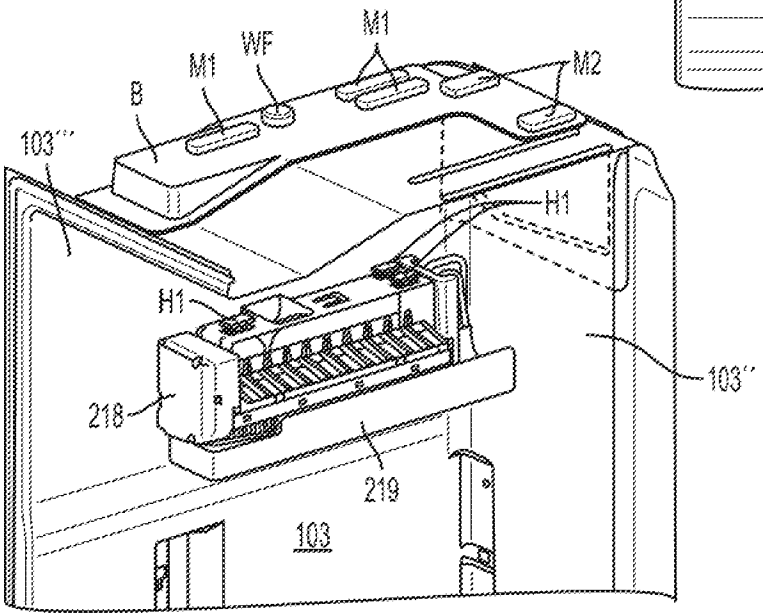
Figure 9:
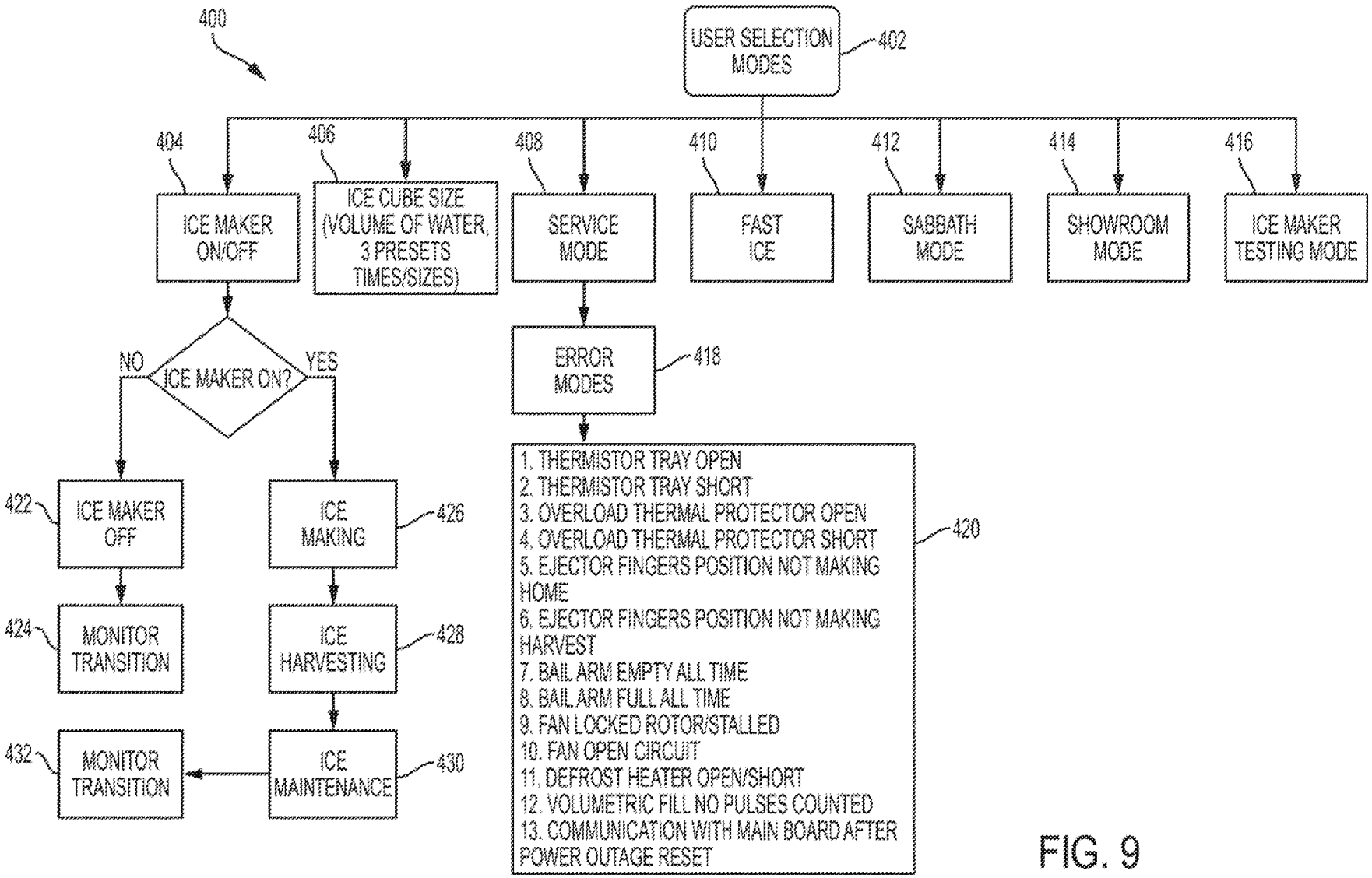
Figure 10:
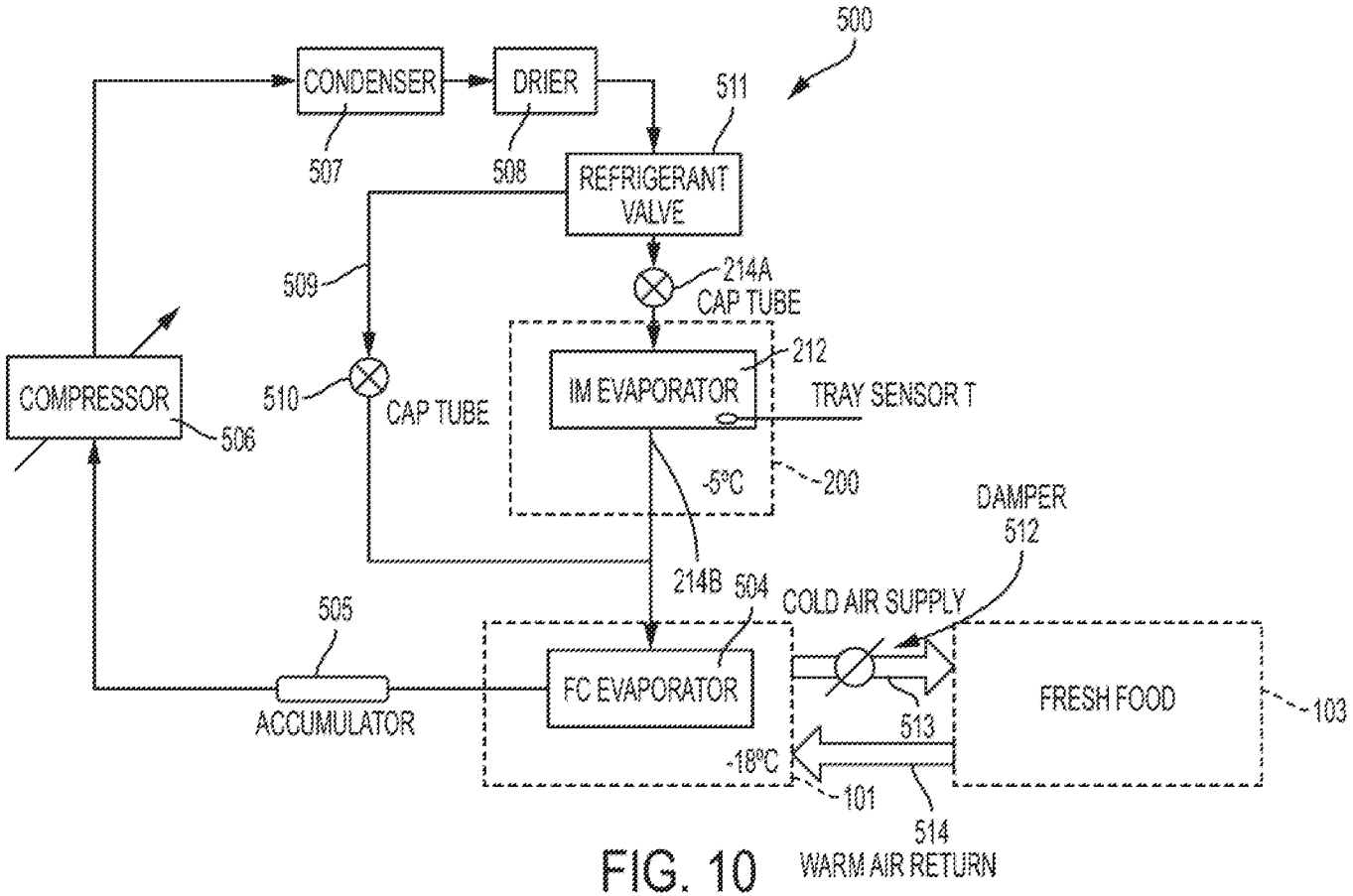
Figure 11:
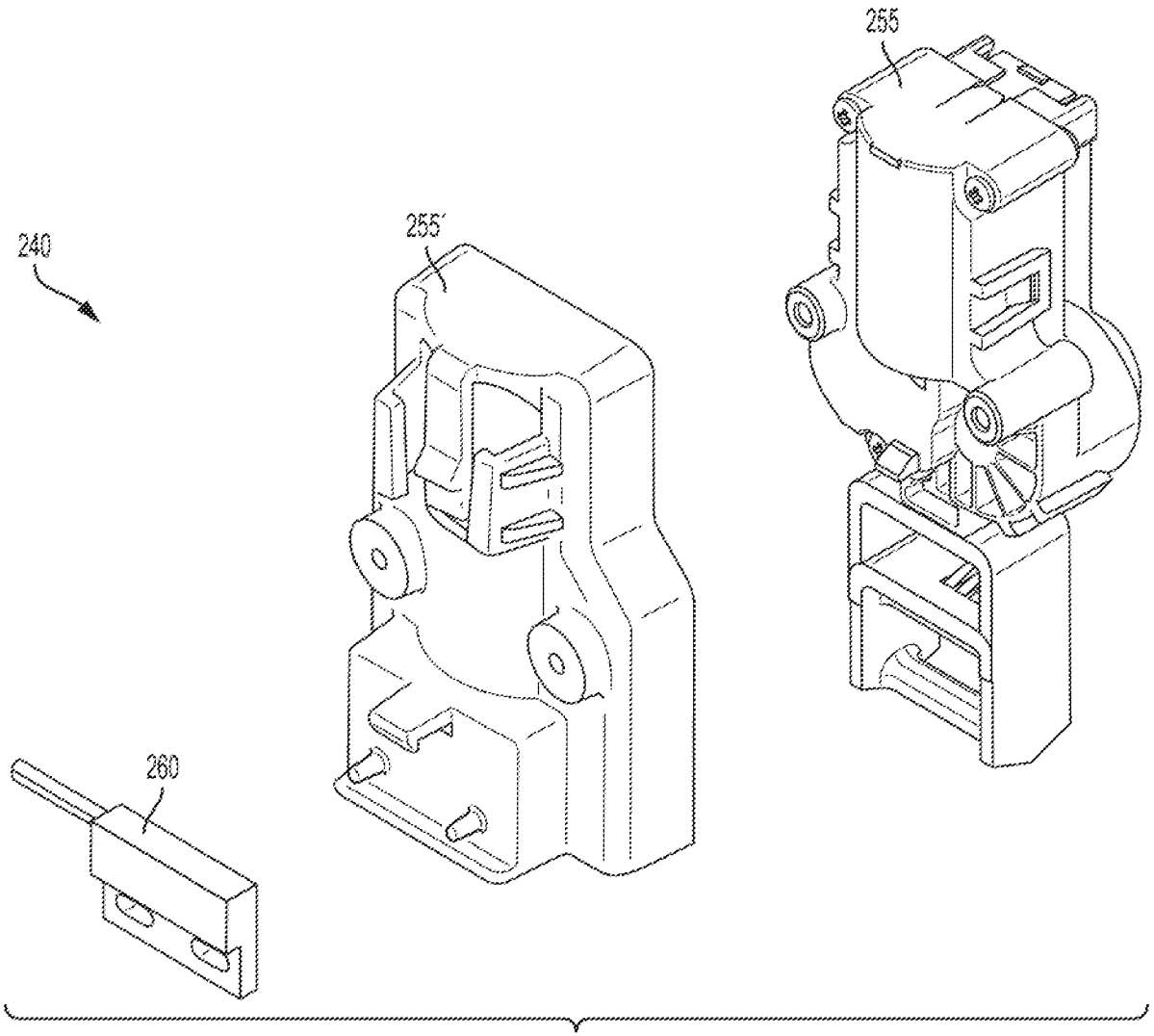

FIGS. 7A, 7B, and 7C are various perspective views of the ice maker assembly showing the air flow and the evaporator fins according to an exemplary embodiment consistent with present disclosure;

FIGS. 8A, 8B, and 8C are various views of the ice maker assembly being mounted to the foamed-in bracket according to an exemplary embodiment consistent with present disclosure;

FIG. 9 is an illustration of a controller showing the control logic for controlling the ice maker system according to an exemplary embodiment consistent with present disclosure;

FIG. 10 shows a freezer compartment/icemaker refrigerant circuit according to an exemplary embodiment consistent with present disclosure;

FIG. 11 shows an exploded perspective view of the cube/crush DC motor and reed switch assembly according to an exemplary embodiment consistent with present disclosure.

Figure 12C:
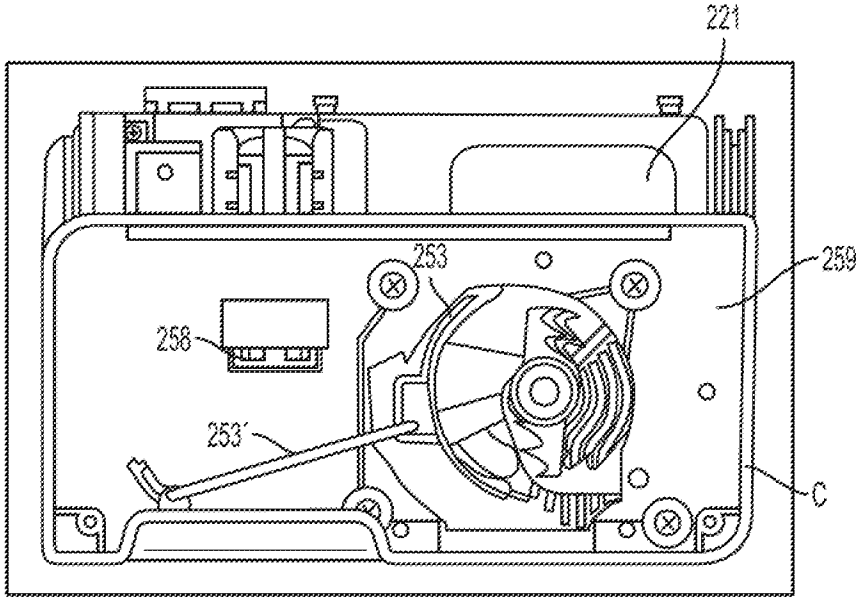
Figure 12D:
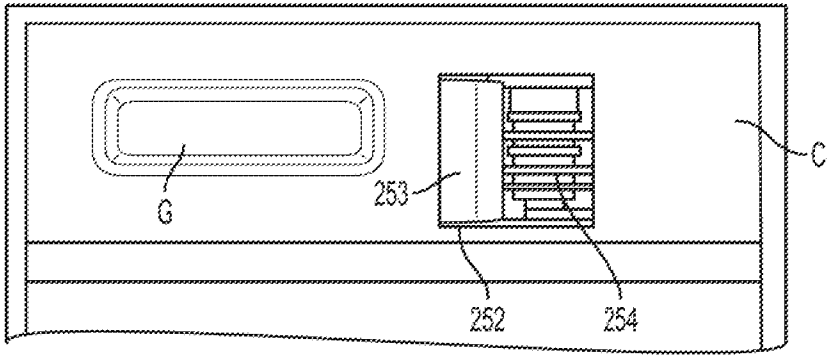
Figure 12A:
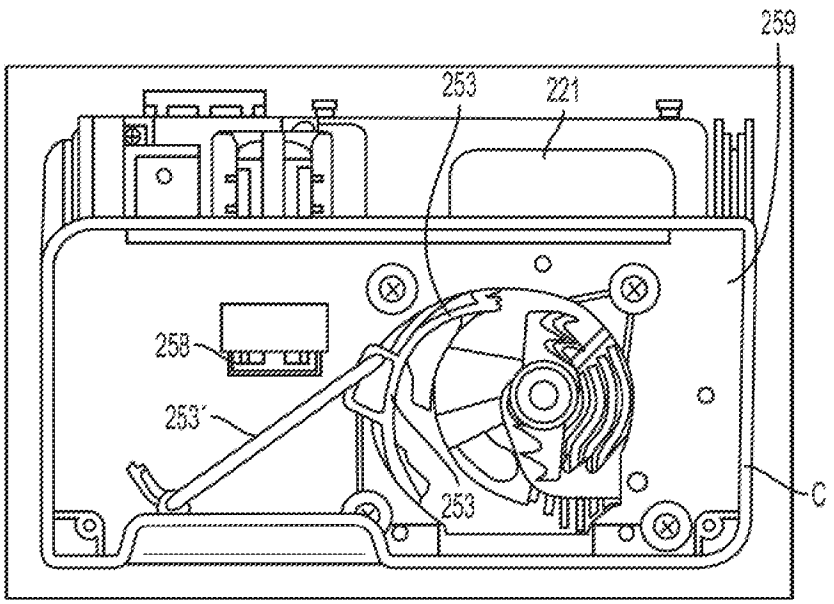
Figure 12B:
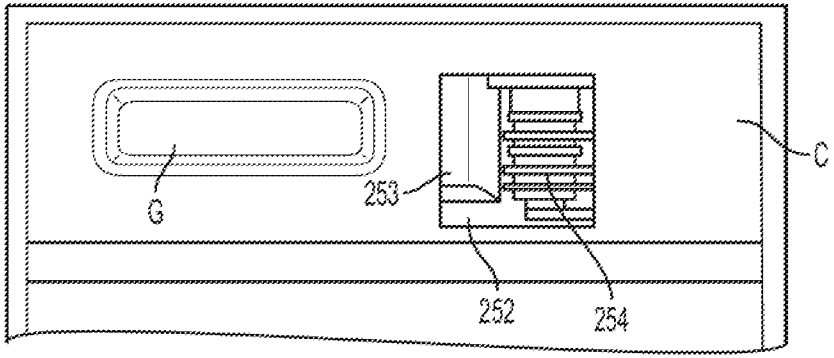
Figure 13C:
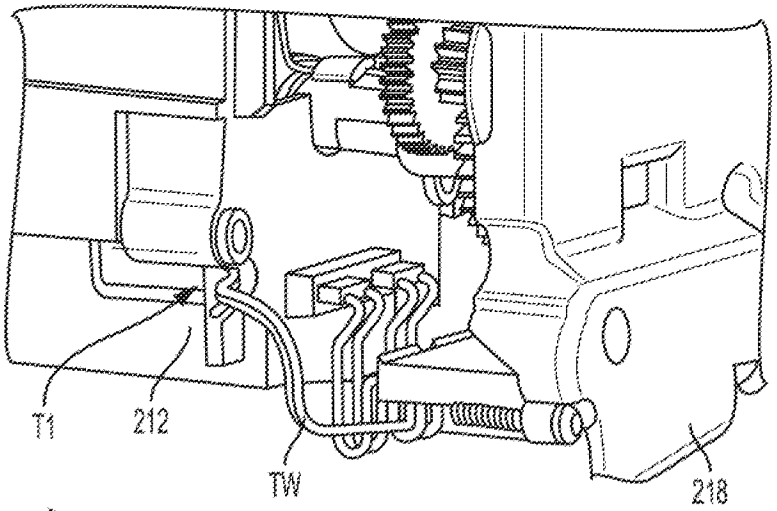
Figure 13B:
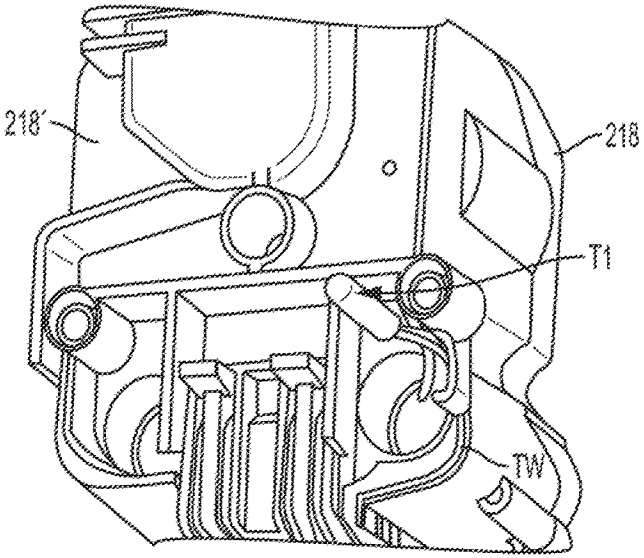
Figure 13A:
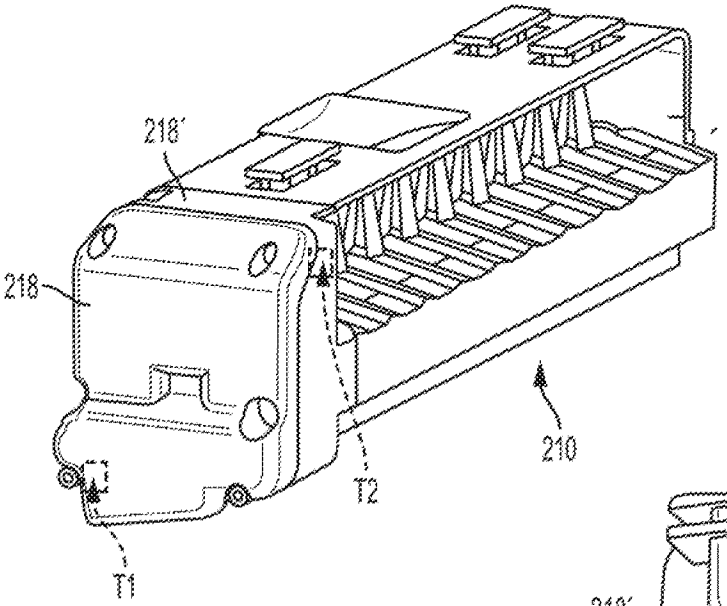

FIGS. 12A, 12B, 12C, and 12D show various views of ice bucket and ice gate assembly according to an exemplary embodiment consistent with present disclosure; and FIGS. 13A, 13B, and 13C show various views of a portion of the ice maker assembly to illustrate the use of two thermistors.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rearward, upper, lower, upward, downward, and the like used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

Figure 1:
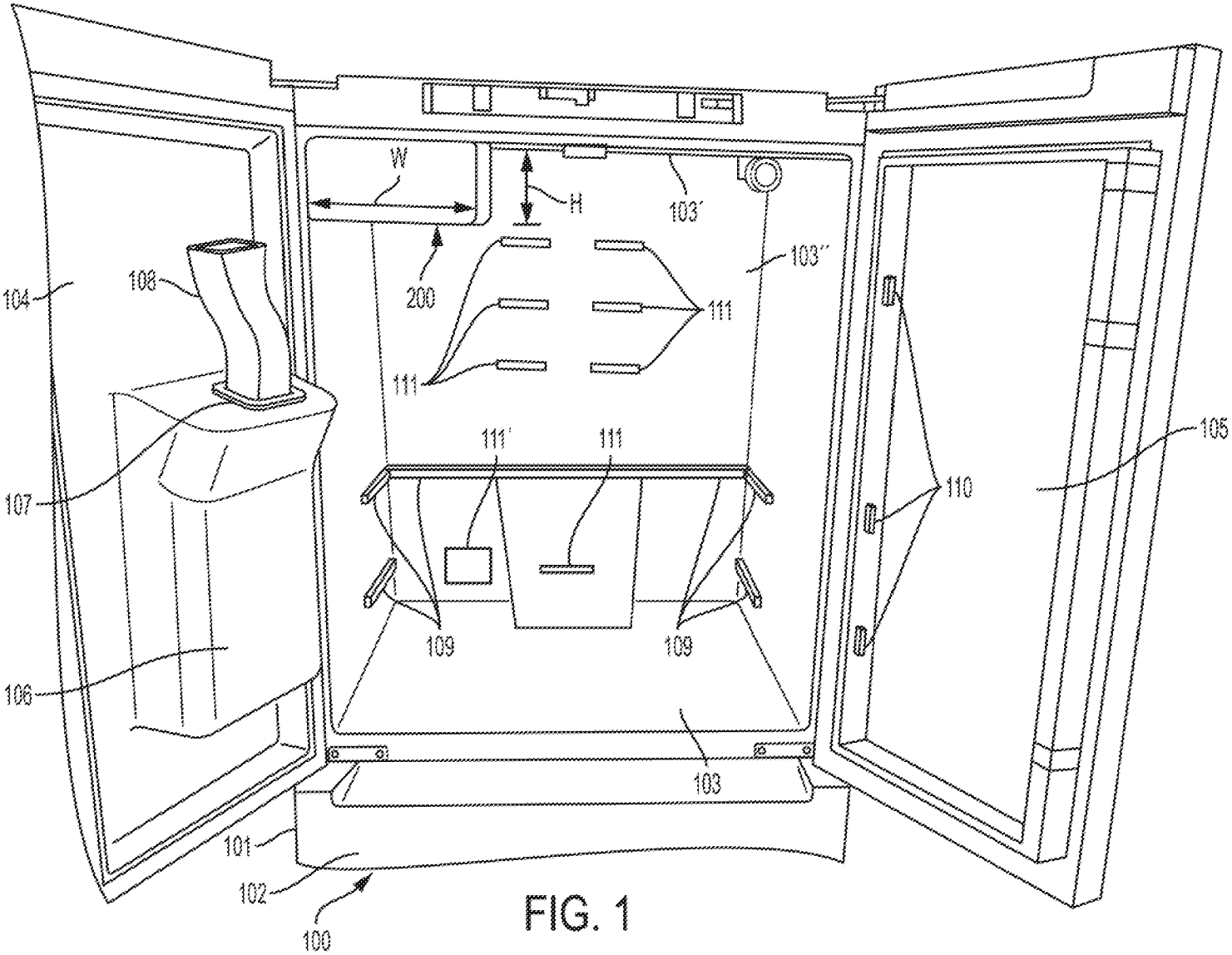
FIG. 1 illustrates a fragmentary front perspective view of a French door-bottom mount style refrigerator with the doors open to reveal the slimline ice compartment according to an exemplary embodiment consistent with present disclosure.

FIG. 1 illustrates a front perspective view of a French door-bottom mount style refrigerator 100 with the doors open to reveal the slimline ice compartment 200 according to an exemplary embodiment consistent with present disclosure. More specifically, the refrigerator 100 includes an insulated body having a freezer compartment 101 (bottom mount style) covered by a freezer door 102, and a fresh food compartment 103 (also referred to as a refrigerator compartment 103) located above the freezer compartment 101 and having two refrigerator doors 104 and 105 (French door style) which are shown in the open position. While two refrigerator doors are shown, clearly a single refrigerator door could be used, or more than two doors such as with door-in-door configurations. The shelves and food racks have been removed from inside the fresh food compartment 103 and from the inside of the refrigerator doors 104 and 105 for ease of understanding. The left door 104 includes a projecting housing portion 106 on the inner liner and which accommodates a water and ice dispenser assembly (not visible) accessible by the user on the front side of the door 104. An opening 107 of a dispenser ice chute (not visible) for guiding ice to the dispenser is arranged at the top of the projecting housing portion 106. As will be described in more detail below, the dispenser ice chute communicates with an opening in a front cover of the ice bucket via an ice chute extension 108. The inner liner side walls of the fresh food compartment 103 include protrusions 109 for supporting shelving (not shown). The right door 105 includes projections 110 for supporting door racks (not shown). Also shown in FIG. 1 are air openings 111 for cold air to enter into the fresh food compartment 103 (see the smaller elongated slots) and an opening 111' for return air to exit the fresh food compartment 103 (see the larger square opening on the bottom left). The freezer compartment is typically set at −18° C. or colder, and the fresh food compartment is typically set in a range of 1° C. to 4° C.

The slimline ice compartment 200 is disposed in an upper left hand corner of the fresh food compartment 103. The slimline ice compartment 200 can be located at other positions within the fresh food compartment 103, in one of the refrigerator doors 104, 105, or even in the freezer compartment 101 if desired, especially in a side-by-side freezer/refrigerator configuration. The slimline ice compartment 200 has a thin dimension in a vertical height direction H of approximately 5.6 inches±2.0 inches and has a horizontal width W of approximately 10.4 inches±2.0 inches.

Figure 2:
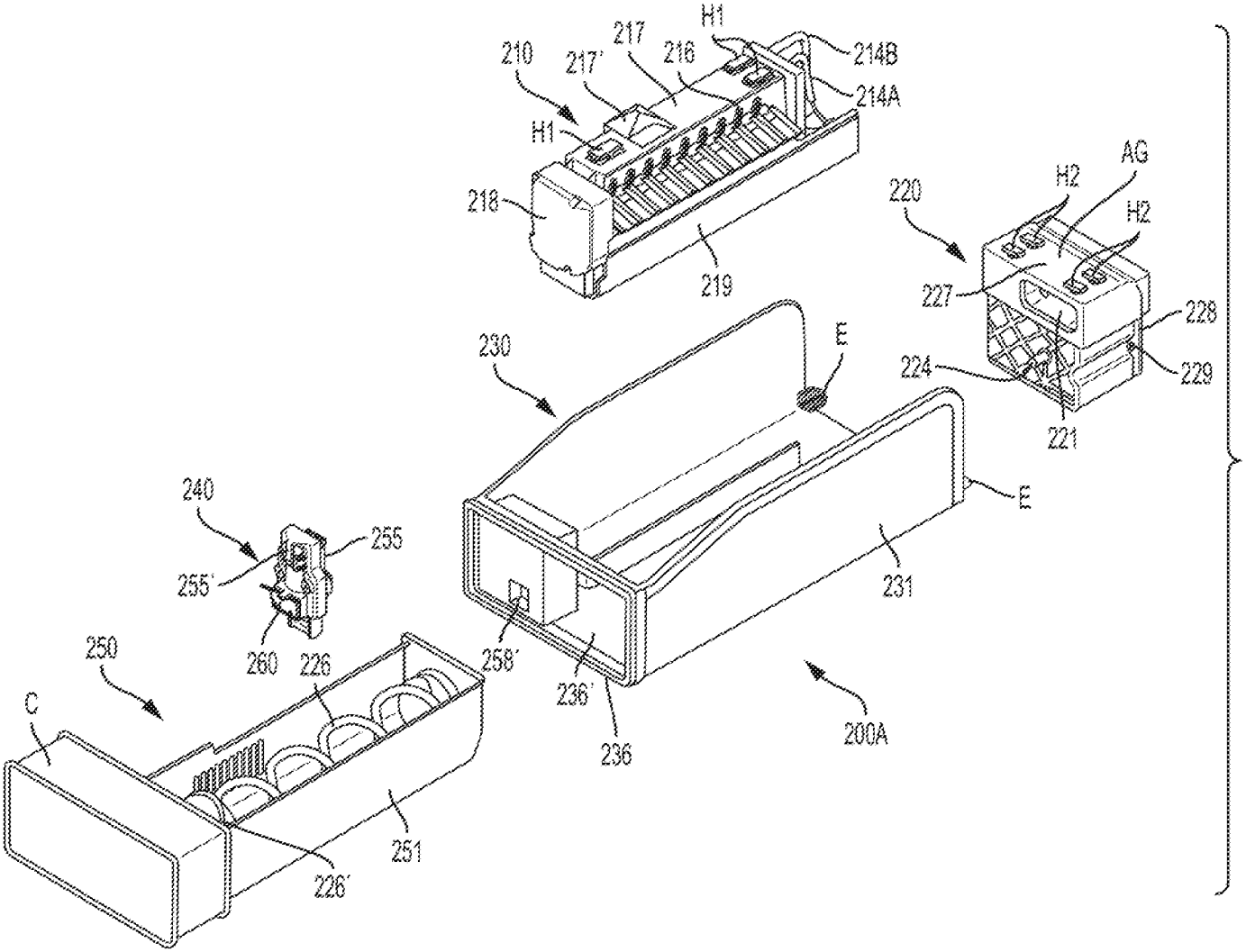
FIG. 2 is an exploded perspective view of the complete ice maker/ice bucket/ice compartment assembly according to an exemplary embodiment consistent with present disclosure.
Figure 3A:
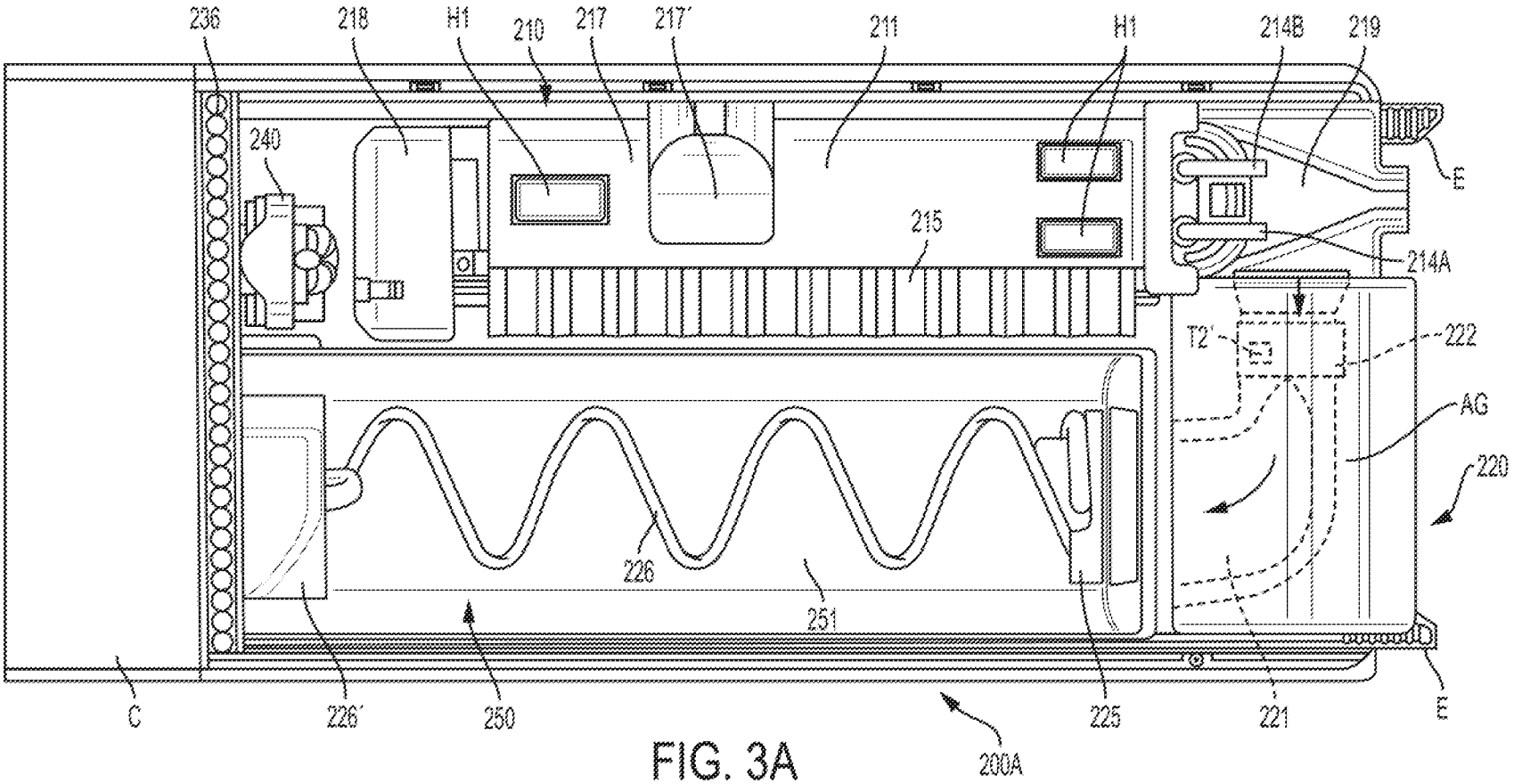
FIG. 3A is a top view of the complete ice maker/ice bucket/ice compartment assembly according to an exemplary embodiment consistent with present disclosure.

FIG. 2 is an exploded perspective view of the complete ice maker/ice bucket/ice compartment assembly 200A (hereinafter referred to as "the complete ice maker compartment assembly 200A") according to an exemplary embodiment consistent with present disclosure. More specifically, the complete ice maker compartment assembly 200A includes an ice maker assembly 210, an air handler/auger motor assembly 220, an ice compartment housing assembly 230, a cube/crush DC motor and reed switch assembly 240, and the ice bucket assembly 250. FIG. 3A is a top view of the complete ice maker compartment assembly 200A according to an exemplary embodiment consistent with present disclosure. Aspects of each of the individual assemblies 210-250 will be discussed in more detail below in connection with the remaining drawings.

Figure 3B:
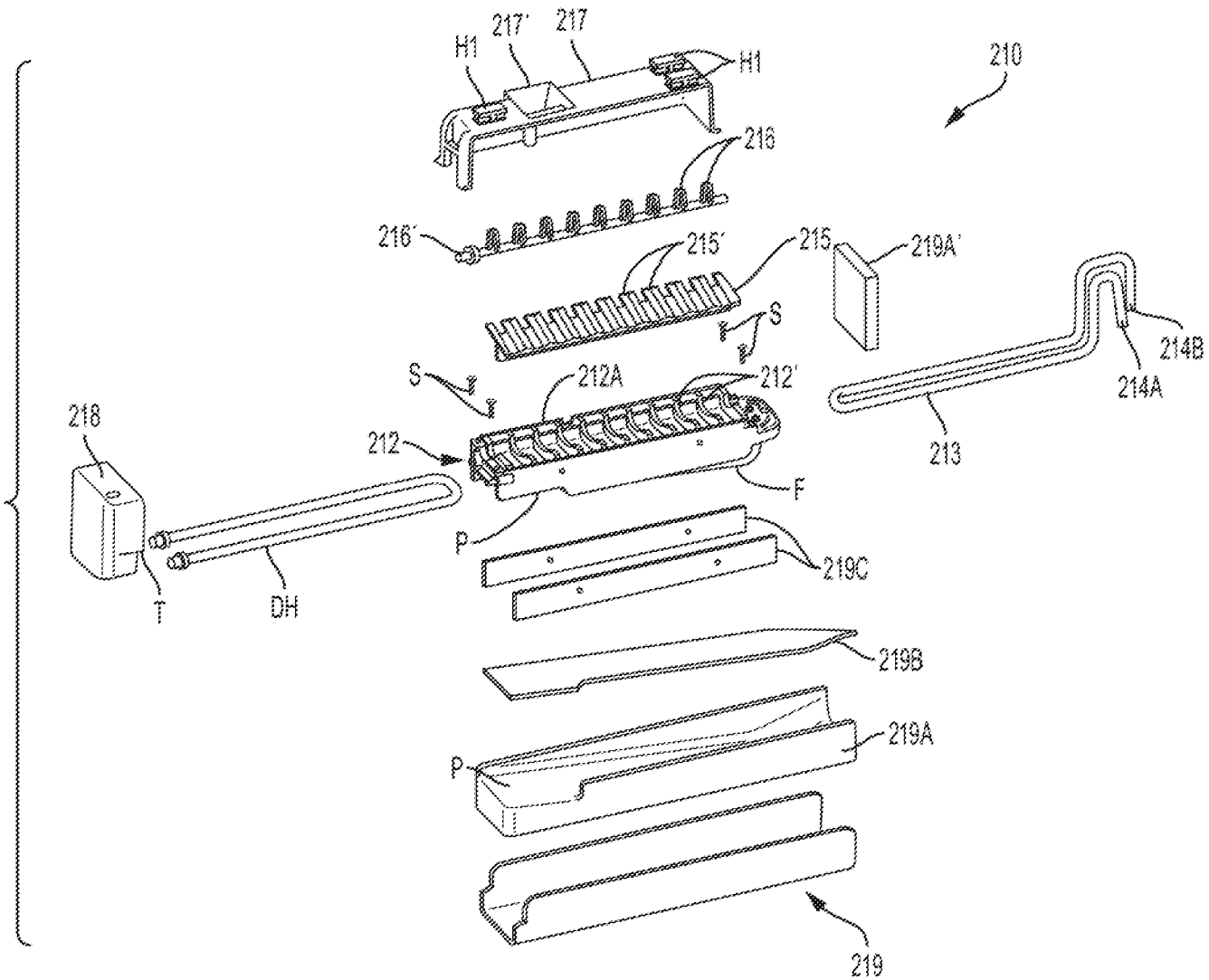
FIG. 3B is an exploded perspective view of the ice maker assembly according to an exemplary embodiment consistent with present disclosure.

As shown in FIGS. 2, 3A, and 3B, the ice maker assembly 210 (which includes an ice maker 211) and the ice bucket assembly 250 (which includes an ice bucket 251) are arranged side-by-side or next to each other in a horizontal direction within the ice compartment housing assembly 230. In other words, no portion of the ice bucket 251 is located below the ice maker 211 when the ice maker 211 is projected downward in a vertical height direction.

With reference to the exploded view of FIG. 3B, the ice maker assembly 210 includes an ice maker tray/evaporator 212 having an evaporator cooling tube 213 (formed of at least one of copper or a copper alloy, for example) which is, for example, die cast over-molded inside an ice maker tray portion 212A (formed of at least one of aluminum, an aluminum alloy, or other die cast alloys, for example), such that the evaporator cooling tube 213 is embedded in and thus in direct contact with the ice maker tray portion 212A so as to form the ice maker tray/evaporator 212 as a one piece unit. Preferably, but not necessarily, the evaporator cooling tube 213 is formed of copper and the ice maker tray portion 212A is formed of aluminum. Alternatively, the ice maker tray/evaporator 212 is made in two halves. The evaporator cooling tube 213 has an evaporator tube inlet 214A with a capillary connection (i.e., the end is swaged and connected to a capillary tube), and an evaporator cooling tube outlet (suction tube) 214B.

As shown in FIG. 10, the evaporator cooling tube 213 (see FIG. 3B) is connected in a refrigerant circuit 500. The refrigerant circuit 500 includes the ice maker tray/evaporator 212 connected by the evaporator cooling tube outlet (suction tube) 214B in series with a freezer compartment evaporator 504 which is in turn connected to an accumulator 505, a compressor 506, a condenser 507, and a drier 508, and then connects to the evaporator tube inlet 214A having the capillary connection. The refrigerant circuit 500 also includes a bypass line 509 with capillary tube 510 and a refrigerant valve 511 which is located prior to the evaporator tube inlet 214A with the capillary connection in order to bypass the ice maker tray/evaporator 212 and communicate the refrigerant to the freezer compartment evaporator 504. The evaporator tube inlet 214A and the evaporator cooling tube outlet 214B are joined to the foamed-in refrigerator cabinet tubes (which are disposed in the insulated space at the rear of the refrigerator 100) by brazing or by a lock ring. The fresh food compartment 103 can use cold air selectively ducted by a damper 512 in a cold air supply 513 from the freezer compartment 101 and returned in a warm air return 514 (see FIG. 10), or can be part of a separate, independent refrigerant circuit having its own compressor, condenser, drier, capillary tube, and evaporator.

With reference to FIGS. 2, 3A, 3B, 6, and 7C, the ice maker tray portion 212A of the ice maker tray/evaporator 212 includes a mold with a plurality of cavities 212' for receiving water for making ice pieces (see FIG. 3B). The ice maker tray/evaporator 212 includes molded evaporator fins F (see FIG. 7C) extending vertically downward from the bottom thereof and into an airflow passage P under the ice maker tray/evaporator 212. The evaporator fins F preferably extend down very close to the bottom surface of a form-fitted metal 219D which forms a defrost tray to avoid ice building up on the defrost tray at 219D (see FIG. 7C). Also, freezing the water in the plurality of cavities 212' from bottom to top is desirable as most of the salts dissolved as precipitates as the water temperature is brought down will be away from the ice tray surfaces thereby reducing accumulation (scale buildup) on the bottom of the ice tray, which in turn can cause problems of ejecting the ice pieces as the refrigerator appliance ages and/or if used in hard water regions.

As best shown in FIGS. 3A, 3B, 4A, 6, 7B, and 7C, an ice maker guard 215 is fastened to the side of the ice maker tray/evaporator 212 facing the ice bucket 251. The ice maker guard 215 includes a plurality of projections or fingers 215'. Ejector fingers 216 are arranged on a rotatable shaft 216' and are movable in spaces between the projections 215'. An ice maker bracket 217 is disposed above the mold with a plurality of cavities 212' and includes a water fill cup 217' for directing water into the cavities 212'. The ice maker bracket 217 is attached via fasteners (for example, four screws S) to the ice maker tray/evaporator 212. The ice maker bracket 217 also includes a plurality (for example three) of mounting hooks H1 on a top surface thereof for engaging corresponding mounting members M1 formed in a foamed-in bracket B which is part of the refrigerator structure (see FIGS. 8A, 8B, and 8C). The mounting hooks H1 allow the ice maker assembly 210 to be easily assembled to an inner top wall or liner 103' of the fresh food compartment 103 via the foamed-in bracket B as shown in FIGS. 8A-8C. FIG. 7B shows a wire harness WH for connecting the ice maker assembly 210 to the refrigerator 100. The wire harness WH may be connected to corresponding connectors (not shown) in, for example, the inner top wall 103' of the fresh food compartment 103 at a location within the ice compartment 200.

As shown in FIG. 3B, a defrost heater DH in the form of a loop is disposed under the ice maker tray/evaporator 212 and is operative to heat the ice maker tray/evaporator 212 during a harvest mode to release the pieces of ice for harvesting the pieces of ice and also serves to prevent any ice or frost buildup on the ice maker tray/evaporator 212 including underneath the same including on the evaporator fins F and on form-fitted metal 219D of the defrost tray (see FIG. 7C). The defrost heater DH can be easily replaced when service is required.

As best shown in FIGS. 2, 3A, 3B, 6, 8A, and 13A-13C, a gear box 218 is positioned at a front end portion (facing the front of the refrigerator) of the ice maker tray/evaporator 212 and includes gears (see FIG. 13C) and a motor (not shown) for driving the rotatable shaft 216' and the bail arm or optical sensor system (not shown) that senses the amount of ice pieces in the ice bucket 251. A temperature or tray sensor such as a thermistor T is disposed on an outer portion of the gear box 218 facing the ice maker tray/evaporator 212 (see FIG. 3B). Alternatively, the thermistor T can be disposed directly on the ice maker tray/evaporator 212 (see FIG. 10, and also see thermistor T1 as discussed below with respect to FIGS. 13A, 13B, and 13C). In this regard, there is no air temperature control inside the slimline ice compartment 200, rather the ice maker tray/evaporator 212 and an electric motor driven fan 222 (discussed in more detail below) within the ice compartment 200 are controlled using the thermistor T which directly monitors the ice/ice maker tray/evaporator 212 temperatures to cycle the motor driven fan 222 and bi-stable refrigerant valve 511 "ON" and "OFF" in order to keep the temperature inside the ice compartment 200 within established limits.

Moreover, instead of just the one thermistor T, an additional temperature sensor may be disposed inside the gear box 218 and sense the temperature of a plastic housing of the gear box 218. In particular, FIGS. 13A, 13B, and 13C show various views of a portion of the ice maker assembly 210 to illustrate the use of two thermistors T1 and T2. FIG. 13A is a schematic drawing showing the general locations of the thermistors T1 and T2 with respect to the gear box 218 (although both thermistors T1 and T2 are shown with broken lines in FIG. 13A as they are covered by the gear box 218). As best shown in FIG. 13B, the tray thermistor T1 extends from the gear box and the wires TW are routed inside the gear box 218. As shown in FIG. 13C, the tray thermistor T1 is inserted inside the ice maker tray/evaporator 212 in order to sense the temperature of the ice maker tray/evaporator 212 (note that in FIG. 13C, a portion of the gear box 218 is removed for ease of understanding). The additional sensor T2 is disposed on the inside of the gear box 218 at a location as shown, for example but not limited to, in FIG. 13A, and senses the temperature of the plastic gear box housing 218'. The additional sensor T2 may be disposed next to an optical sensor (not shown) for sensing the ice level in the ice bucket 251. The optical sensor may be attached, for example, to the gear box 218 and be snapped in as separate part. Still further, the additional temperature sensor may be built into a body of the electric motor driven fan 222 (see the additional temperature sensor T2' (e.g., a thermistor) in FIG. 3A).

As best shown in FIGS. 2, 3B, 6, 7A-7C, and 8A, a drain assembly 219 having insulation 219A and 219A' (formed from, for example, expanded polypropylene (EPP)), a metal (for example, aluminum) drain plate 219B, and a collar 219C is positioned under and attached with the ice maker tray/evaporator 212. While the metal drain plate 219B is shown in FIG. 3B as a flat metal plate, it can also be form-fitted to the insulation 219A to form the defrost tray as shown at 219D in FIG. 7C. The drain assembly 219 is configured with an angle toward the rear so as to drain any water from a defrost mode of the ice maker assembly 210 away from a rear end portion (see FIGS. 6 and 7C) of the ice maker assembly 210 and communicates with tubing (not shown) which in turn communicates with an evaporation tray (not shown) in a machine room of the refrigerator 100. The drain assembly 219 also cooperates with the bottom of the ice maker tray/evaporator 212 to form the airflow passage P under the ice maker tray/evaporator 212 and through the evaporator fins F.

Figure 4B:
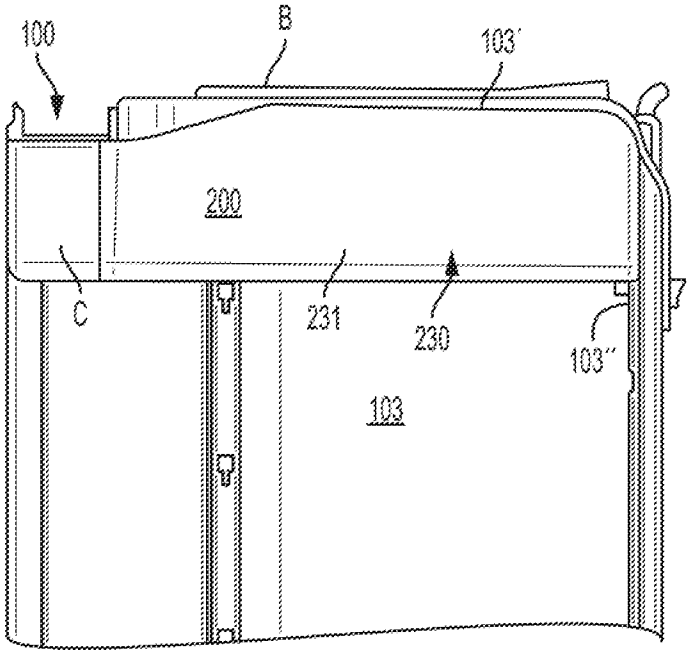
FIG. 4B is a fragmentary side elevational view showing the exterior of the ice compartment inside the refrigerator compartment according to an exemplary embodiment consistent with present disclosure.
Figure 4A:
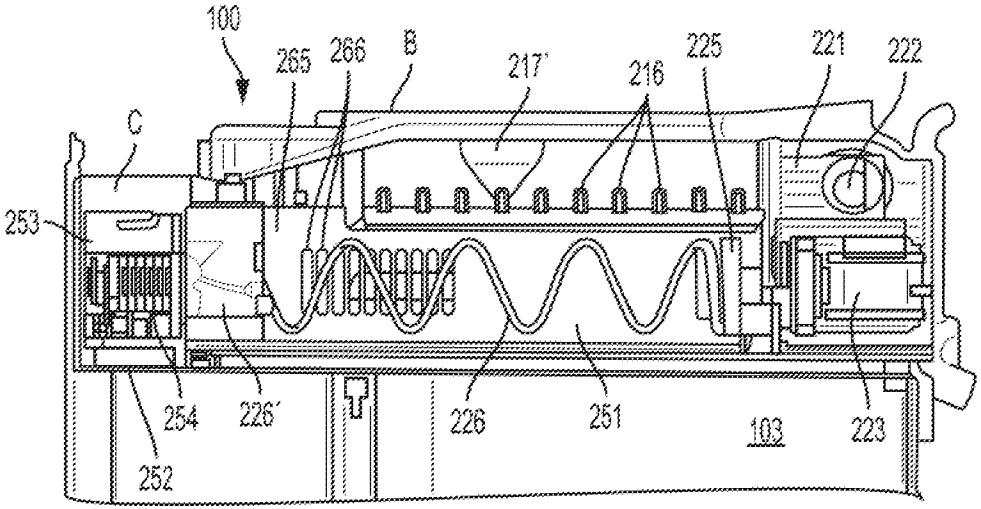
FIG. 4A is a fragmentary cutaway side elevational view showing the complete ice maker/ice bucket/ice compartment assembly according to an exemplary embodiment consistent with present disclosure.

With reference to FIGS. 2, 3A, and 4A, the air handler/auger motor assembly 220 is disposed at the rear portion of the slimline ice compartment 200. The air handler/auger motor assembly 220 includes an air guide AG with an air passage 221 having the electric motor driven fan 222 disposed therein. Although the electric motor driven fan 222 is shown with a vertical orientation, the electric motor driven fan 222 can also be oriented horizontally in a vertical portion of the air passage 221. The air passage 221 is located at an upper portion of the air handler/auger motor assembly 220. The air passage 221 communicates with a rear end portion P2 (see FIGS. 6 and 7B) of the airflow passage P under the ice maker tray/evaporator 212. An inlet of the electric motor driven fan 222 communicates with the airflow passage P under the ice maker tray/evaporator 212 and through the evaporator fins F such that the electric motor driven fan 222 creates a suction and draws cool air from the ice maker tray/evaporator 212 and discharges the cool air through the air passage 221 and either over or around the ice bucket 251 to prevent the ice pieces from melting. The cool or cold air that circulates inside the ice compartment 200 is only required to keep the ice compartment 200 cold enough to prevent ice stored in the ice bucket 251 from melting which is normally below −3° C. and preferably, but not necessarily, around −5° C. The air passage 221 makes a substantially 90 degree turn and widens prior to emptying into the ice bucket 251. An auger motor 223 is located at a lower portion of the air handler/auger motor assembly 220. The auger motor 223 includes a motor shaft 224 that is connected via a coupler 225 to an auger member 226 such as a coiled auger wire or tube or the like. The other end of the auger member 226 is connected to an auger drum 226' which guides the ice pieces to the crushing blades and the opening in the front cover which are discussed later.

The air handler/auger motor assembly 220 includes a plurality (for example four) of mounting hooks H2 on the top surface 227 (see FIG. 2) for engaging corresponding mounting members M2 (shown schematically in FIGS. 8A and 8B) formed in the foamed-in bracket B which is part of the refrigerator structure for mounting the air handler/auger motor assembly 220 to the fresh food compartment 103. The air handler/auger motor assembly 220 may also include one or more vertical mounting plates 228 with fastener holes 229 (see FIG. 2) for further mounting the air handler/auger motor assembly 220 to an inner back wall or liner 103" of the fresh food compartment 103 via fasteners such as screws (not shown).

Figure 5:
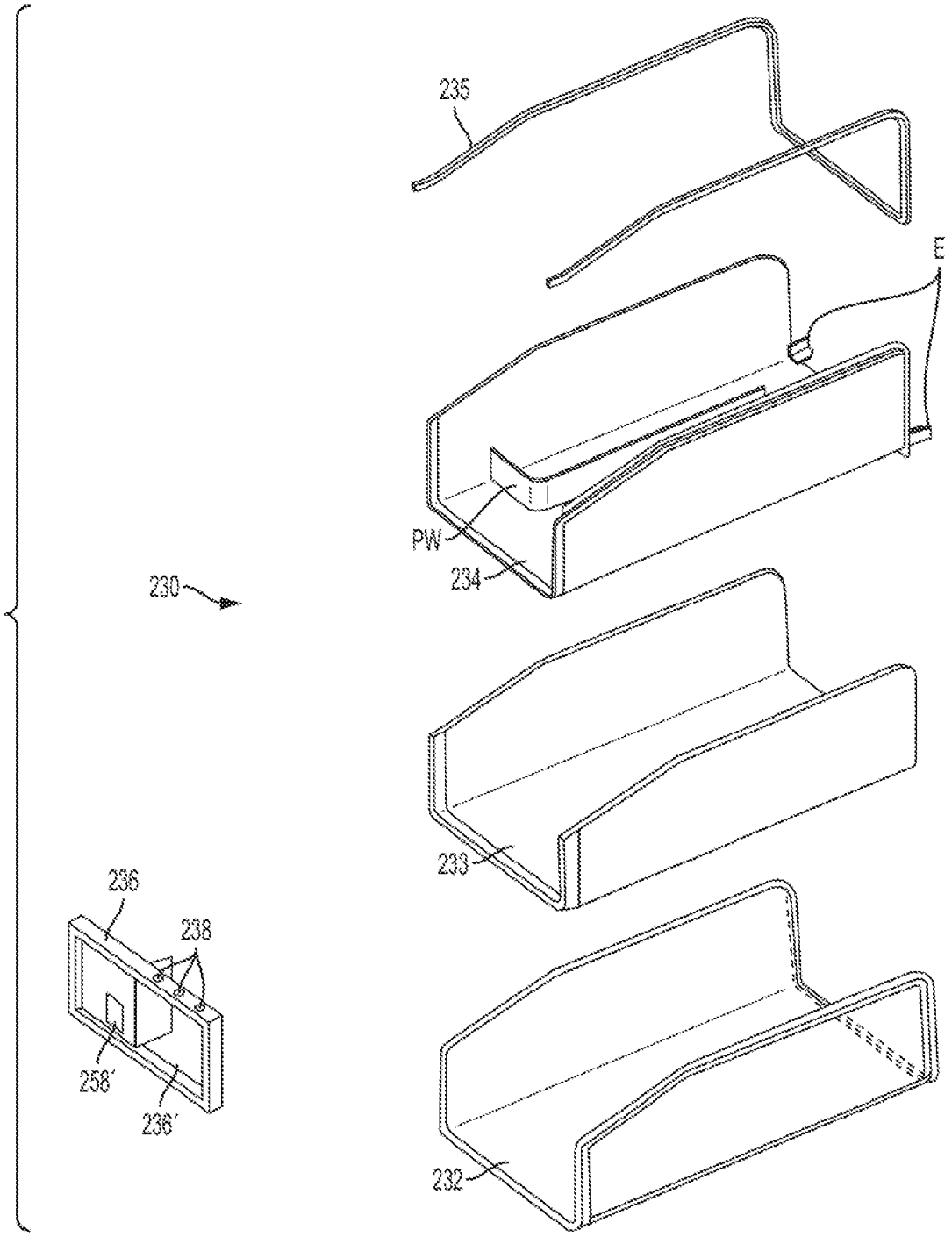
FIG. 5 is an exploded perspective view of a U-shaped ice compartment assembly according to an exemplary embodiment consistent with present disclosure.
Figure 6:
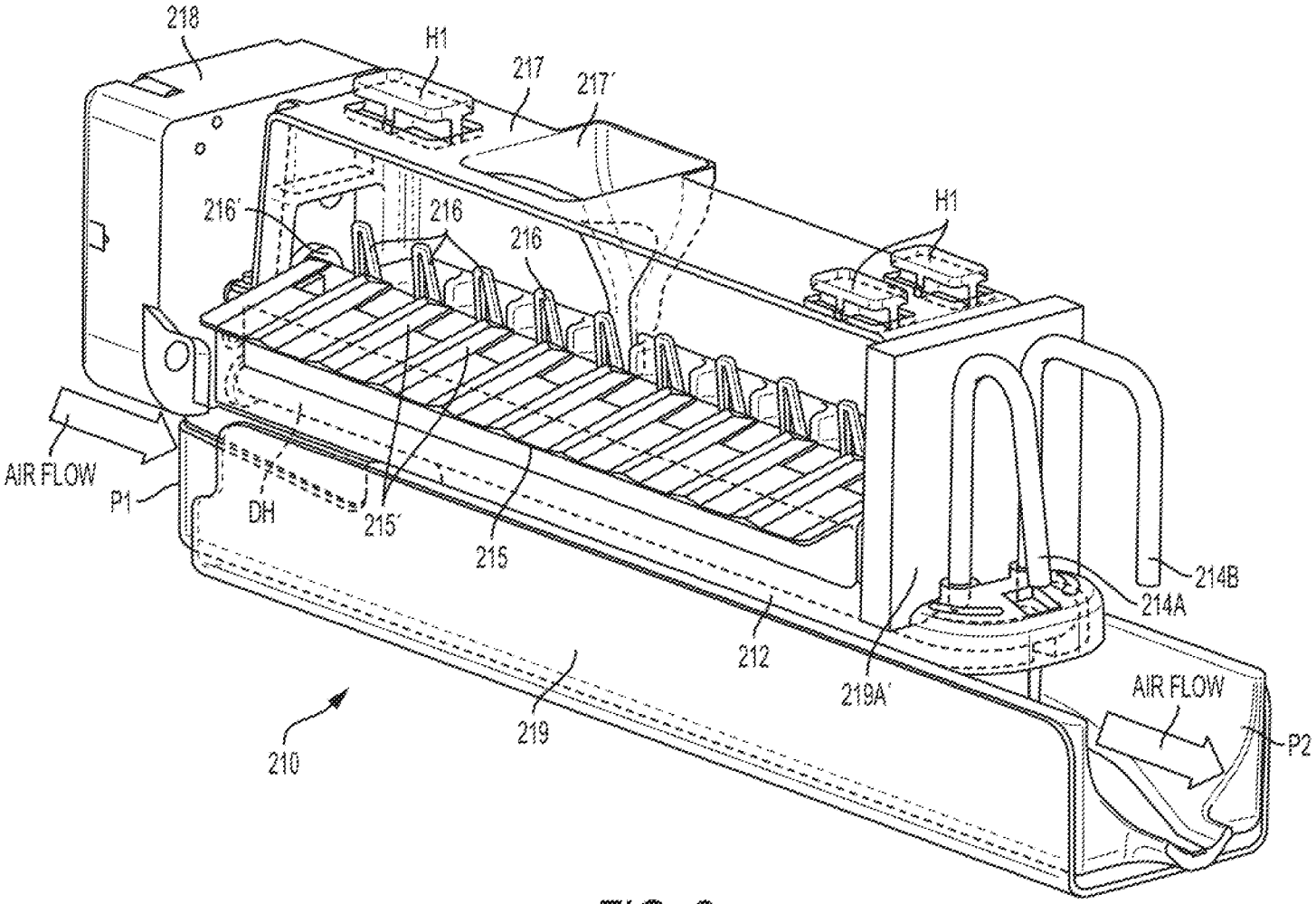
FIG. 6 is a perspective view of the ice maker assembly according to an exemplary embodiment consistent with present disclosure.

As best shown in FIGS. 2, 4B, and 5, one embodiment of the ice compartment housing assembly 230 is formed by a U-shaped, insulated housing 231 that cooperates with the inner top wall 103' and the inner back wall 103" of the fresh food compartment 103. As best shown in FIG. 4B, the U-shaped, insulated housing 231 is contoured to fit the shape of the inner top wall 103' and an inner back wall 103" of the fresh food compartment 103. The U-shaped, insulated housing 231 includes a U-shaped outer wall 232, a U-shaped insulation 233 (formed of, for example, expanded polypropylene (EPP), expanded polystyrene (EPS), vacuum insolated panel (VIP)), a U-shaped inner wall 234, a gasket 235 that is disposed between an edge of the U-shaped, insulated housing 231 and the inner top wall 103' and the inner back wall 103" of the fresh food compartment 103, and a housing collar 236 that is disposed on an open front portion of the U-shaped, insulated housing 231, the housing collar 236 having an opening 236' therein for receiving the ice bucket 251. The gasket 235 may be an extruded gasket formed from, for example, polyvinyl chloride (PVC) that is rubberized, and that is inserted into a groove that is formed along the edge of the U-shaped, insulated housing 231. The U-shaped, insulated housing 231 includes an inner L-shaped positioning wall PW (see FIG. 5) for positioning the U-shaped, insulated housing into position over the ice maker assembly 210. The U-shaped, insulated housing 231 also includes locating extensions E (for example, two extensions E) extending from a lower rear portion of the edge, the locating extensions E being configured to fit into a bracket (not shown) positioned in the inner back wall 103" of the fresh food compartment 103. Moreover, the housing collar 236 having the opening 236' therein for receiving the ice bucket 251 further includes a plurality of fastener holes 238 configured to receive fasteners (for example, three screws, not shown) for fastening the U-shaped, insulated housing 231 to the inner top wall 103' of the fresh food compartment 103. With such a construction, the U-shaped, insulated housing 231 is slid into position in the upper left hand corner of the fresh food compartment 103 and over the ice maker assembly 210 and then held in place by the locating extensions E at the lower rear portion and the fasteners in the holes. The insulated housing 231 is not limited to a U-shape and can also be other shapes such as, for example, L-shaped.

With reference to FIGS. 2, 3A, 4A, 11, and 12A-12C, the cube/crush DC motor and reed switch assembly 240 is disposed within the ice compartment housing assembly 230 at a location in front of the ice maker assembly 210 and is mounted, for example, to a back wall of the housing collar 236 or similar. The cube/crush DC motor and reed switch assembly 240 is used to control whether cubed or crushed ice is delivered to the user. More specifically, the ice bucket or bin 251 has an ice bucket outlet opening 252 (seen from bottom in FIGS. 12B and 12D) in a front cover C through which ice pieces are delivered, as will be described in more detail below. As shown in FIGS. 12A and 12C, the ice bucket outlet opening 252 has an ice gate 253 that pivots, such that the ice gate 253 opens or closes. When the ice gate 253 is closed (see FIGS. 12C and 12D), it forces the ice pieces, such as in the shape of cubes, towards a plurality of crushing blades 254 (for example, when "crushed" ice is selected by the user). On the other hand, when "cubed" ice is selected by the user, the ice gate 253 opens (see FIGS. 12A and 12B) thus allowing the ice cubes to come out through the ice bucket outlet opening 252 missing the crushing blades. The default position for the ice gate 253 is closed, and this minimizes any ice cubes from falling out through the ice bucket opening 252 when the user pulls out the ice bucket 251. This also prevents the user from touching the blades while pulling out the ice bucket 251. The pivoting of the ice gate 253 is carried out by a rod 253' (see FIGS. 12A and 12C) that engages into an actuator head that is controlled by a cube/crush DC reversible motor 255 (for example, a 12 volt DC reversible electric motor as shown in FIG. 11) that moves up (closing the ice gate 253) and down (opening the ice gate 253). The rod 253' passes through an opening 258' in the housing collar 236 (see FIG. 2). The ice bucket assembly 250 has a magnet 258 disposed on a gate cover 259 of the front cover C of the ice bucket assembly 250 and that interfaces with a reed switch 260 that is assembled on a motor bracket 255' of the cube/crush DC reversible motor 255 (see FIGS. 2 and 11). Accordingly, when the ice bucket 251 with front cover C is removed from the opening 236' in the housing collar 236 of the ice compartment 200, the reed switch 260 opens the circuit thereby disabling: any ice dispensing, the ice maker 211, and the electric motor driven fan 222. This in turn prevents any ice harvesting while the ice bucket 251 is not present, and also minimizes moisture ingress inside the ice compartment 200. Once the ice bucket 251 is placed back into the ice compartment housing assembly 230, the normal operation is resumed.

With reference to FIGS. 2, 3, 4A, 12B, and 12D, the ice bucket assembly 250 includes the ice bucket or bin 251 for storing ice pieces and in which the auger member 226 is disposed, and the front cover C. As noted above, the ice bucket 251 is removably mounted in the slimline ice compartment 200. As shown in FIG. 4A, in one embodiment, an inner side wall 265 of the ice bucket 251 is formed with a plurality of through-holes or slots 266 which allow the air that has cooled the ice to exit the ice bucket 251 and enter at a front end portion P1 of the airflow passage P under the ice maker tray/evaporator 212 to be cooled again (see FIGS. 7A and 7B). As noted above, the front cover C has the ice bucket outlet opening 252 on the bottom through which ice pieces are delivered when a user dispenses ice pieces. The ice bucket outlet opening 252 cooperates with the ice chute extension 108 to deliver ice pieces to the dispenser when the door 104 is in a closed position. The interface between the ice bucket outlet opening 252 and the top of the ice chute extension 108 can be sealed with a gasket, have a partial or open gasket, or have no gasket at all. In the latter two cases, some air is permitted to move between the fresh food compartment 103 and the ice compartment 200 by moving into the region inside the ice chute extension 108 and through the ice bucket outlet opening 252 and into the ice compartment 200 and vice versa.

FIGS. 12B and 12D show that the bottom of the front cover C also includes a gripper recess G for the user to insert their fingers to pull and remove the ice bucket 251 or return the same into position. The hollow inside of the front cover C includes insulation, and the insulation may entirely fill the inside of the front cover C. Alternatively, the lower region around the ice bucket outlet opening 252 may be free of any insulation.

FIG. 9 is an illustration of a controller 400 showing the control logic for controlling the ice maker system according to an exemplary embodiment consistent with present disclosure. More specifically, the controller 400 may be formed by a dedicated control board (for example, a computer processor or microprocessor and including suitable memory for storing various information) for the ice making system and includes a plurality of user selection modes 402 that may be disposed, for example, on a control panel on the front of the refrigerator. The user selection modes 402 include, but are not limited to, an ice maker ON/OFF 404, ice cube size 406 (for example, volume of water, 3 preset times/sizes), service mode 408, fast ice 410, Sabbath mode 412, showroom mode 414, and ice maker testing mode 416.

Under the service mode 408, error modes 418 are included. The error modes 418 can include a number of error situations 420 including but not limited to the following: thermistor on tray—open; thermistor on tray—short; overload thermal protection—open; overload thermal—short; ejector fingers—position not making it home; ejector fingers—position not making it to harvest; bail arm—empty all the time; bail arm—full all the time; fan locked rotor/stalled; fan—open circuit; defrost heater—open/short; volumetric fill—no pulses counted; and communication with main refrigerator board after POR (power outage reset).

In connection with the ice maker ON/OFF mode 404, when the ice maker 211 is OFF as at 422, the controller 400 monitors the transition as at 424. On the other hand, when the ice maker 211 is turned ON, the controller 400 is configured to control ice making 426, ice harvesting 428, and ice maintenance 430, as well as monitor transition as at 432. The controller 400 is configured to control ice making, ice harvesting, and ice maintenance based on the temperature sensed by the at least one tray temperature sensor T.

During the ice making mode, the refrigerant valve 511 (see FIG. 10) directs the refrigerant in a liquid state through the evaporator cooling tube 213 that is in direct contact with the ice maker tray portion 212A. A water fill valve (not shown) that is located in the water fill tube that connects to the connection WF (see FIG. 8B) is opened in order to fill the cavities 212' with water and then is closed after a predetermined period of time (e.g., 5 seconds) has elapsed. Further, the electric motor driven fan 222 circulates air by drawing air through the evaporator fins F in the airflow passage P under the ice maker tray/evaporator 212 to cool the air in the ice compartment 200 to prevent the ice pieces in the ice bucket 251 from melting.

During the ice harvesting mode, once the water in the individual cavities 212' is frozen, which is determined by the tray temperature sensor (e.g., thermistor) T that continuously senses the icemaker tray/evaporator 212 until a predetermined temperature (e.g., ≤−14° C.) is reached, the refrigerant valve 511 is then switched so as to bypass or divert the refrigerant gas to, for example, the freezer evaporator 504 and then the defrost heater DH is turned "ON". Once a predetermined temperature is reached, the defrost heater DH is turned "OFF" and the ejector fingers 216 are rotated by the shaft 216' to scoop out the ice pieces (for example, ice cubes) from the tray cavities 212'. During the harvesting process, the defrost heater DH is cycled ON and OFF as necessary to maintain the ice maker temperature within predetermined range. After a complete turn of 360 degrees of the ejector fingers, the defrost heater DH is switched OFF and the cycle is restarted with water by the water fill valve (see connection WF for a water fill tube in FIG. 8B) filling the cavities 212' and the refrigerant valve 511 redirecting the refrigerant to the ice maker tray/evaporator 212.

During the ice maintenance mode, there is no air temperature control sensor inside the ice compartment 200. Once the ice level detection, for example a bail arm or optical sensor system (not shown) detects that the ice bucket 251 is full, the ice maker 211 stops ice production and the controller 400 now operates in the ice maintenance mode to maintain the ice compartment at a temperature just cold enough to prevent the ice from melting (e.g., around −5° C.). The ice compartment 200 temperature is maintained by cycling the bi-stable refrigerant valve 511 which directs the refrigerant through the ice maker tray/evaporator 212 combined with the cycling of the electric motor of the electric motor driven fan 222. The logic controlling rate and duration at which the bi-stable refrigerant valve 511 and fan motor of electric motor driven fan 222 are cycled ON and OFF relies upon temperature readings from the ice tray thermistor T1, in conjunction with an additional temperature sensor T2 which may be inside the housing of the gear box 218 or built into a body of electric motor driven fan 222. There is no sensor to directly monitor the temperature of the air within the ice compartment. Alternatively, the controller 400 can maintain the ice compartment 200 temperature within established thresholds just by using the ice maker tray portion temperature sensor T by itself, without any additional temperature sensor.

Note that at times the system of the present disclosure is described as performing a certain function. However, one of ordinary skill in the art would know that the program is what is performing the function rather than the entity of the system itself.

Although aspects of one implementation of the present disclosure are depicted as being stored in memory, one skilled in the art will appreciate that all or part of systems and methods consistent with the present invention may be stored on or read from other non-transitory computer-readable media, such as secondary storage devices, like hard disks, floppy disks, and CD-ROM, or other forms of a read-only memory (ROM) or a random access memory (RAM) either currently known or later developed. Further, although specific components of the system have been described, one skilled in the art will appreciate that a system suitable for use with the methods and systems consistent with the present disclosure may contain additional or different components.

The present invention has substantial opportunity for variation without departing from the spirit or scope of the present invention. For example, while FIG. 1 shows a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like. Also, while the slimline ice compartment is shown in the fresh food compartment, the slimline ice compartment could be disposed in a freezer compartment.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:

a fresh food compartment;

a freezer compartment;

an ice compartment disposed in the fresh food compartment;

an ice maker disposed in the ice compartment, the ice maker including an ice maker tray, an ice maker evaporator, and a cooling tube which is disposed between the ice maker tray and the ice maker evaporator, such that the cooling tube is in direct contact with the ice maker tray and the ice maker evaporator; and a refrigeration circuit comprising a compressor, a condenser, a drier, a refrigerant valve, first and second capillary tubes, the ice maker evaporator, and a freezer compartment evaporator, wherein the refrigerant valve is configured to direct a refrigerant to one of a first path or a second path of the refrigeration circuit, the first path causing the ice maker evaporator to work in series with the freezer compartment evaporator, and the second path causing the refrigerant to bypass the ice maker evaporator and expand directly into the freezer compartment evaporator, wherein, in the first path connected to the refrigerant valve, a capillary tube outlet of the first capillary tube is connected to an inlet of the cooling tube of the ice maker evaporator and an outlet of the cooling tube is connected to the freezer compartment evaporator, such that an initial expansion of the refrigerant occurs at the cooling tube of the ice maker evaporator and continues on to the freezer compartment evaporator, and wherein, in the second path, the second capillary tube bypasses the cooling tube of the ice maker evaporator and directs the refrigerant directly to the freezer compartment evaporator.

2. The refrigerator of claim 1, wherein the fresh food compartment uses cold air selectively ducted by a damper in a cold air supply from the freezer compartment and returned from the fresh food compartment to the freezer compartment in a warm air return.

3. The refrigerator of claim 1, wherein the fresh food compartment is part of a separate, independent refrigerant circuit having its own compressor, condenser, drier, capillary tube, and evaporator.

* * * * *